United States Patent [19]

Weber

[11] 4,020,930

[45] May 3, 1977

[54] DOUBLE ACTION BRIEF CASE

[75] Inventor: Maurice J. Weber, Des Plaines, Ill.

[73] Assignee: Trimco Mfg. & Engineering Inc., Chicago, Ill.

[22] Filed: Aug. 1, 1974

[21] Appl. No.: 493,766

[52] U.S. Cl. ..... 190/51; 150/1.6

[51] Int. Cl.[2] ..... A45C 3/02; A45C 13/10

[58] Field of Search ..... 150/1.6; 190/41 R, 44, 190/45, 46, 48, 51, 52; 292/DIG. 42; 70/64–76, 263

[56] References Cited

UNITED STATES PATENTS

| | | | |
|---|---|---|---|
| 698,558 | 4/1902 | Rosenbaum | 190/52 |
| 1,214,687 | 2/1917 | Klein et al. | 292/DIG. 42 |
| 1,460,016 | 6/1923 | Emery | 190/51 X |
| 1,637,223 | 7/1927 | Holtzman | 190/52 X |
| 1,752,948 | 4/1930 | Herrmann | 190/52 X |
| 1,950,252 | 3/1934 | Lewis | 190/52 |
| 2,205,118 | 6/1940 | Friedman | 190/46 |
| 2,294,794 | 9/1942 | Morelli | 190/52 |
| 2,875,868 | 3/1959 | Powell | 190/44 |
| 2,918,997 | 12/1959 | Rotkins | 190/51 |
| 3,298,479 | 1/1967 | Palmer et al. | 190/51 |
| 3,306,405 | 2/1967 | Rosenblum | 190/51 |

FOREIGN PATENTS OR APPLICATIONS

| | | | |
|---|---|---|---|
| 128,496 | 4/1947 | Australia | 190/51 |
| 280,373 | 12/1930 | Italy | 190/52 |
| 659,112 | 10/1951 | United Kingdom | 190/51 |
| 358,759 | 10/1931 | United Kingdom | 190/52 |

*Primary Examiner*—R. E. Hart
*Assistant Examiner*—Stephen Marcus
*Attorney, Agent, or Firm*—Alter and Weiss

[57] ABSTRACT

A brief case comprises two oppositely disposed side shells which are hinged together at a centrally located valence. Double action locks on the valence individually lock or otherwise secure each of the two side shells in position adjacent the valence. When the lock mechanism is operated in one manner, one side shell is released, and when the lock mechanism is operated in another manner the other side shell is released. A special procedure is required to release both side shells simultaneously. The valence includes a closed, deep tray compartment which may be either permanently or releasably secured therein. The deep tray faces one side shell to cooperate with that side shell and form a completely closed compartment. The bottom of the tray blocks the other side shell from view.

5 Claims, 8 Drawing Figures

DOUBLE ACTION BRIEF CASE

This invention relates to double action luggage and more particularly to brief cases which are adapted to be opened on either of two sides, individually—but not simultaneously, unless an intentional act is performed.

In general, the term "double action" brief case is used hereinafter to describe a type of brief case wherein either of two sides may be controlled independently of the other two sides. A brief case of this type might, for example, be used to transport both business papers on one side and personal belongings, such as clothing or the like, on the other side. A brief case of this type is sometimes a source of embarrassment since it is possible to open or spill a part containing clothing when one is present at a business meeting where only a display of business papers is intended, for example. The social situation becomes doubly embarrassing when the clothing is soiled or otherwise personal in nature.

Accordingly, an object of this invention is to provide a brief case of the above described type wherein it is impossible to inadvertently display the contents of one side of the brief case when the other side is open. Here an object is to provide a compartment for receiving clothes or other personal items while providing another compartment for receiving only business papers. In this connection an object of the invention is to provide a locking mechanism which precludes a simultaneous opening of both sides, unless a deliberate action is intentionally performed.

In keeping with an aspect of this invention, the double action brief case comprises two oppositely disposed, five sided shells hinged to each other via a centrally located valence member. The open or sixth side of each of the two oppositely disposed side shells come together in a face-to-face relationship on the opposite sides of the valence. Double action lock means are provided on the valence for respectively and individually locking, or otherwise securing, each of the two side shells when in a closed position adjacent the valence. When the lock mechanism is operated in one manner, one side shell is released to give access to the goods and equipment therein. When the lock mechanism is operated in another manner the other side shell is released, likewise to give access to the goods and equipment therein. A special and intentional procedure is required to release both side shells simultaneously. The valence includes a closed deep tray compartment permanently or releasably secured therein. The open side of the deep tray faces one side shell to cooperate therewith and form a closed compartment while the closed bottom of the tray completely blocks from view the closed compartment when the other side shell is opened.

The nature of preferred embodiments for accomplishing the above stated and other objects may become more apparent from a study of the attached drawing wherein.

Figure 1:
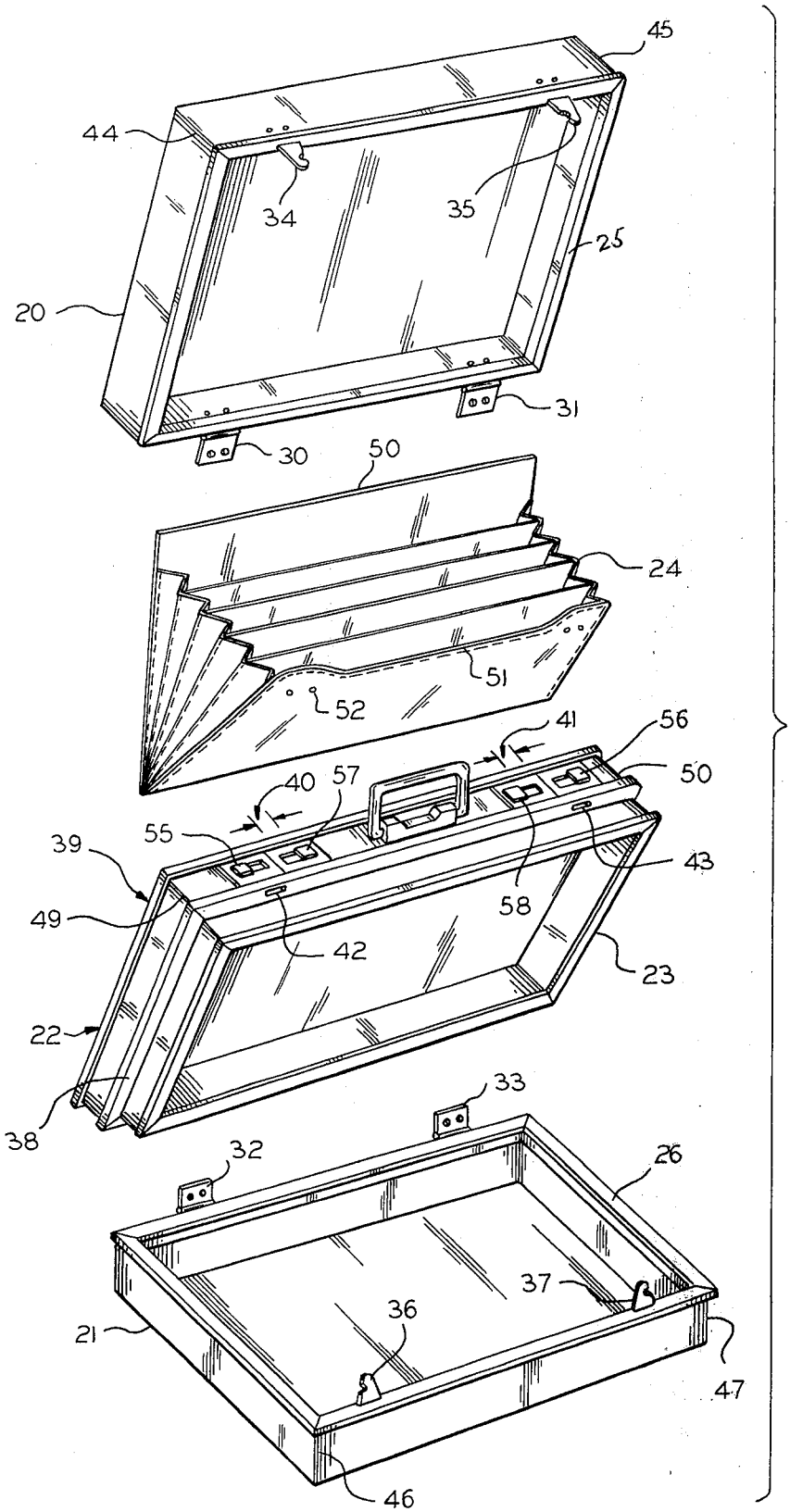
FIG. 1 is an exploded view of the inventive brief case.
Figure 4:
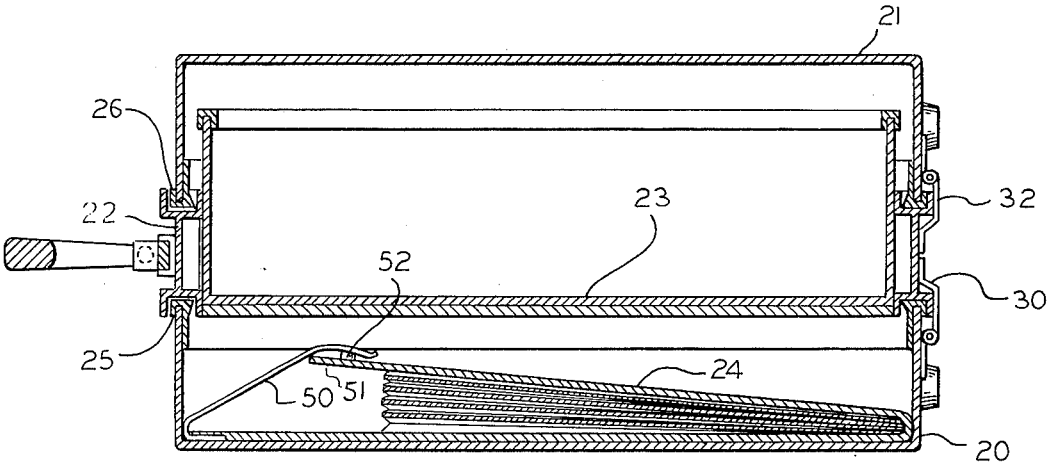
FIG. 4 is a cross-sectional view taken along line 4—4 of FIG. 2.

The major assemblies in the inventive two way brief case are a pair of oppositely disposed, five sided shells 20, 21, a valence 22, a closed deep tray compartment 23, and an optional file wallet or compartment 24 for business papers. Each of the shells 20, 21 may be formed in any suitable and well known manner. For example, they may be vacuum formed of blow molded plastic, stamped from sheet metal (with or without plastic covering), or made from wood, leather, or cloth. Depending upon the material used, each of the shells may or may not terminate at a separate and individual reinforcing metal rim or frame 25, 26. The manner of attachment between frames 25, 26 (if used) and the shell is irrelevant to the invention.

Regardless of whether the frames 25, 26 are or are not used, each of the oppositely disposed, five sided shells 20, 21 has a pair of individually associated hinges 30–33 and hasps 34–37 associated with their sixth or open side. The hinges are fastened to opposite sides of the valence 22. Thus, the shells may be folded up to a closed position against the valence or down to an open position. When folded to the closed position, the peripheries of the shells (represented by frames 25, 26) come to rest against mating, spaced, parallel channels or edges on the opposite sides of the valence 22. The exact manner of valence to shell contact is also irrelevant to the invention, since any well known frame may be used.

The valence 22 includes four keepers 40–43 for individually receiving and capturing each of the hasps 34, 35 and 36, 37. (The keepers 40, 41 are not visible in FIG. 1; therefore, their locations are schematically indicated.) The pair of hasps 34, 35 are further displaced from the shell edges 44, 45 than the pair of hasps 36, 37 are displaced from the shell edges 46, 47. Therefore, the keepers 40, 41 are also displaced a corresponding distance further than the keepers 42, 43 are displaced from the valence edges 49, 50. Accordingly, when shell 20 is closed against the valence 22, the hasps 34, 35 enter keepers 40, 41. When shell 21 is closed, hasps 36, 37 enter keepers 42, 43.

Figure 3:
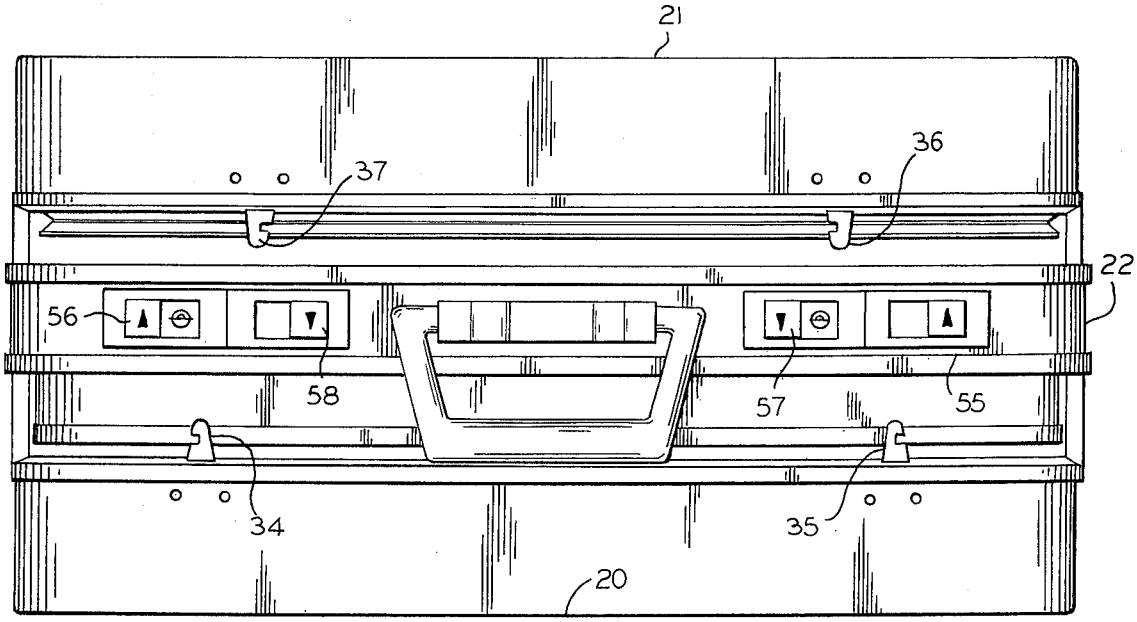
FIG. 3 is a top plan view similar to that of FIG. 2 except that both side shells are partially opened to reveal the construction of the lock mechanism.
Figure 5:
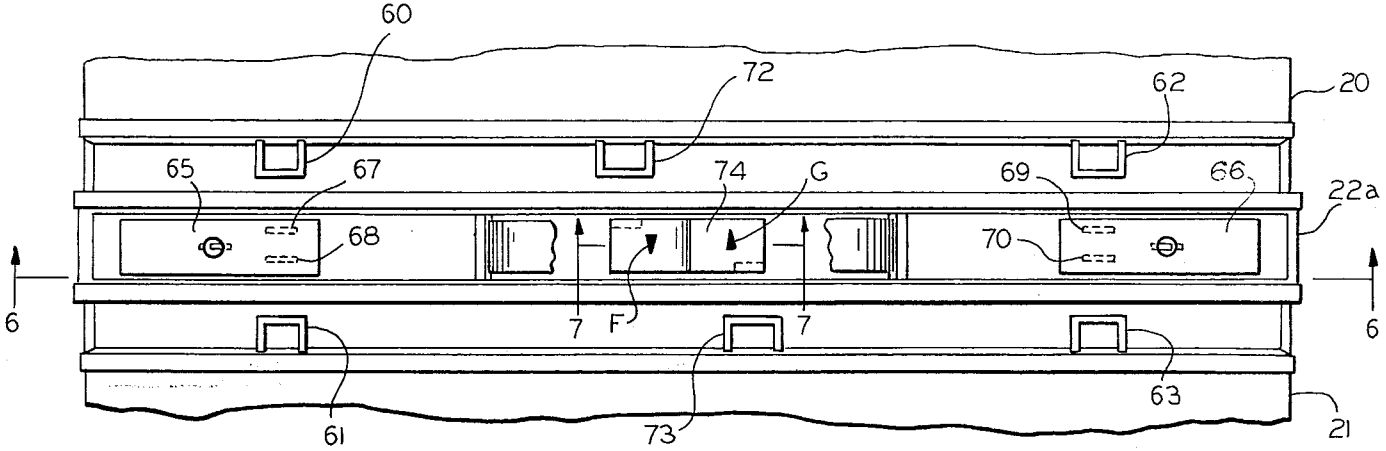
FIG. 5 is a top plan view similar to FIG. 3, but showing a second embodiment of the invention using a toggle clasp.

One set of locks 55, 56 captures the hasps 36, 37. Another set of locks 57, 58 captures the hasps 34, 35. For example, if locks 57, 58 are slid longitudinally toward the outside edges 49, 50 of the case, hasps 34, 35 are released, and side 20 may be folded to an open position. If locks 55, 56 are slid away from edges 49, 50 and toward the center of the case, hasps 36, 37 are released and side 21 may be opened. These are two separate and independent unlocking actions. Hence, either side of the case may be unlocked and opened independently of the other side. However, the act of sliding the lock 55 to the right, for example, will not cause lock 57 to slide to the left, even if the user is inattentive, careless, or clumsy. Any rightward movement would be forcing lock 57 toward its closed—not its open—position. Lock 56 (FIG. 3) may be key controlled to lock side 21, and lock 57 may be key controlled to lock side 20. Of course, other locking arrangements may also be provided.

From the foregoing, it should be apparent that either side of the brief case may be opened individually or that both sides may be simultaneously opened—but only by an intentional act and not by accident.

The valence 22 integrally contains a closed deep tray five side compartment 23, which is positioned with its sixth or open side facing the open side 26 of shell 21 and with its closed bottom facing the open side 25 of the other shell 20. Preferably, the tray 23 is integrally attached (as by rivets, not shown) to the valence 22, so that it (the tray) cannot be removed. An alternative would be to attach the tray 23 to the valence 22 in some removable manner, but captured so that it cannot be unintentionally removed. For example, draw bars, turn buckel, locks or the like could be positioned inside tray 23 to capture mating locking means on the valence 22. This way, the tray 23 and side shell 21 cooperate to make a relatively large compartment for receiving and storing clothes, or the like. The solid bottom of tray 23 closes side 20 so that nothing in side 21 may be seen when side 20 is open.

the other side shell 20 may be constructed in any suitable manner, as, for example, to store papers. As here shown, an expandable wallet style file compartment 24 may be secured inside the shell 20. This wallet file 24 may take any suitable and known form. It may be either riveted or cemented inside the shell 20. Or, it may be releasably secured inside the shell. If it is removable, the wallet top 50 may be adapted to fold down over front 51 and snap into a closed position, as at snaps 52, to provide an independently usable under arm brief case. If not removable, then the snap at 52 may merely receive a strap attached to shell 20 for holding the file 24 in a closed position.

FIGS. 5–8 show another embodiment of the invention for independently locking either side of the brief case. Here the locking arrangement is rearranged in order to avoid having to provide the four independently usable locks as at 55–58, thereby reducing costs.

In greater detail, both of the sides 20, 21 have their own independent hasps 60–63 for capturing opposite ends of the shells 20, 21. On the valence are two latch bars or locks 65, 66, each having two independent bolts 67, 68 and 69, 70 for individually capturing the hasps 60, 61 and 62, 63, respectively. Obviously, if unrestrained, both side shells 20, 21 of the brief case would open each time that the locks 65, 66 are moved in direction X, to an open position.

Figure 7:
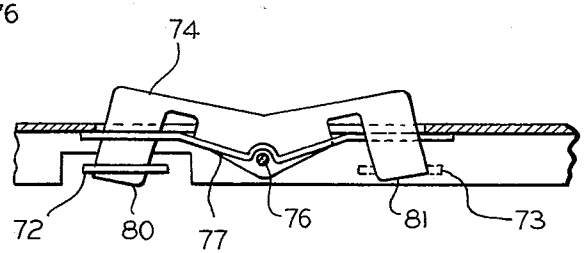
FIG. 7 is a schematical view of the toggle clasp of FIG. 5, 6 in a neutral position, which locks both sides of the brief case.

To independently control the two sides of the brief case, each side shell has an independent hasp 72, 73—which may be either jointly or separately captured by a toggle clasp 74. The toggle clasp 74 is pivotally mounted in its center on a pivot pin 76. A leaf spring 77 is also mounted on the pin 76 and braced against toggle clasp 74 to bias it to a center position. In the centered position, a pair of dependent arms 80, 81 on the toggle clasp 74 decend through hasps 72, 73 to capture both side shells 20, 21 so that neither can be opened. This centered position is seen in FIG. 7.

Figure 6:
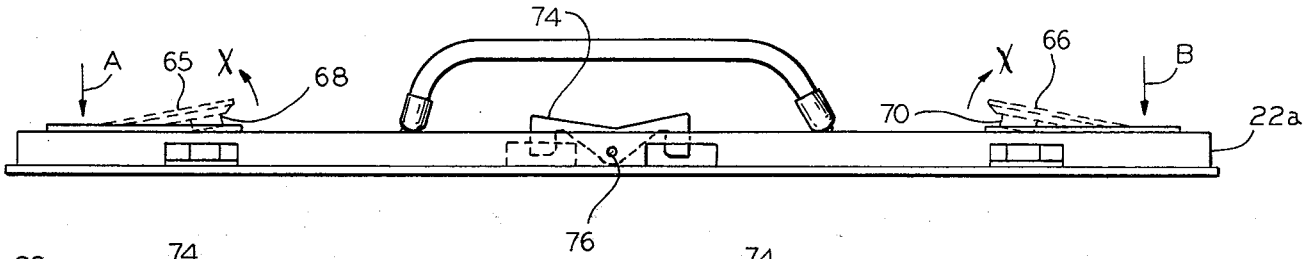
FIG. 6 is a fragmentary side elevation view of the valence of FIG. 5 taken along line 6—6 of FIG. 5.
Figure 8:
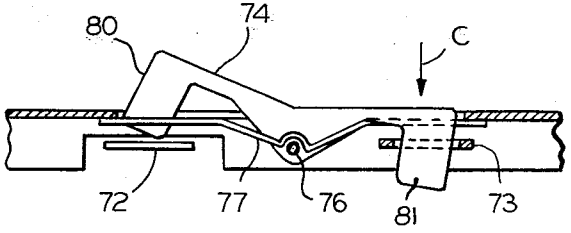
FIG. 8 is a schematical view (similar to FIG. 7) of the toggle clasp in an off-normal position, which locks one shell while unlocking the other shell of the brief case.

To open the brief case, both of the latches or locks 65, 66 are respectively depressed on one end, as indicated by the arrows A, B (FIG. 6). The bolts 67–70 are withdrawn in direction X from the hasps 60–63. Then, a selected end of the toggle clasp 74 is depressed, as indicated by the arrow C (FIG. 8). This causes the opposite end of the toggle clasp to raise and thereby remove the dependent arm 80 from the hasp 72. This means that side shell 20 may be opened. Simultaneously, the dependent arm 81 is moved further into a capture position for the hasp 73 so that the side shell 21 cannot be opened.

If it is desirable to open the side 21, the opposite end of the toggle clasp is pressed to rock it about pivot pin 76, in a direction opposite to that shown in FIG. 8. In this case, the dependent arm 81 is raised to release the hasp 73. The dependent arm 80 is depressed to further capture the hasp 72. This time, side shell 21 may be opened and side shell 20 cannot be opened.

Hence, it is seen that either (but not both) of the side shells 20, 21 may be opened individually. If it is desirable to open both shells simultaneously, it is necessary to rock the toggle clasp 74 one way to release one side shell and then the other way to release the other side shell. This way, both side shells 20, 21 may be opened simultaneously, but only by an intentional action.

Figure 2:
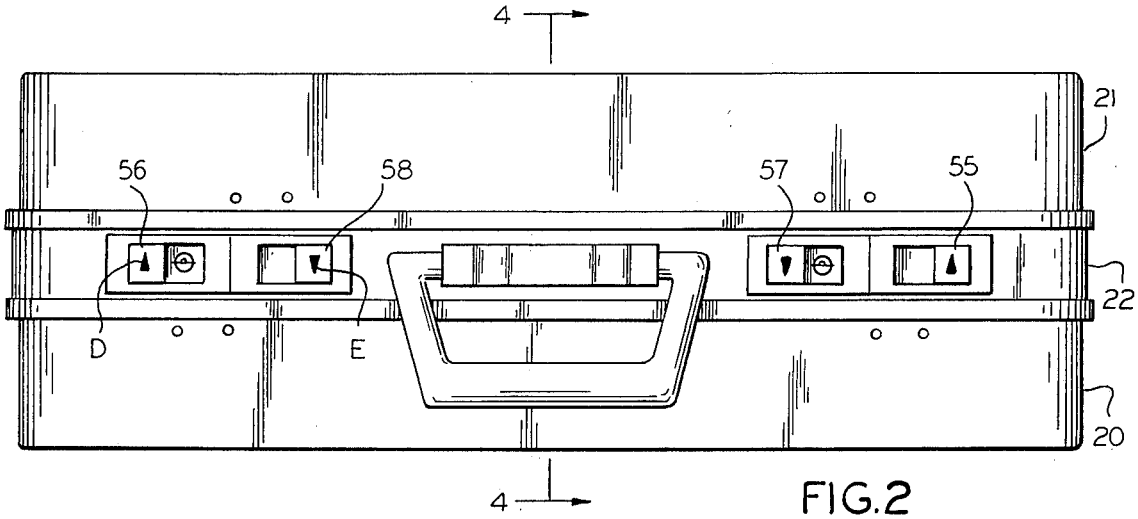
FIG. 2 is a top plan view showing a first embodiment of the inventive brief case in a closed position.

For convenience of operation, the locks 55–58 and the toggle clasp 74 may be marked in any suitable manner to indicate which operation is required to release any given side. For example, locks 55, 56 are marked (as at D, FIG. 2) to indicate that they control access to shell side 21. Locks 57, 58 are marked (as at E) to indicate that they control access to side shell 20. Likewise, toggle clasp 74 is marked at F (FIG. 5) to indicate that side shell 21 is opened when the end of the toggle clasp 74 is pushed. The arrow G indicates that the side shell 20 is released when that end is pushed. Of course, any other suitable marking may also be provided.

Since those skilled in the art will readily perceive many modifications which may be made, the appended claims are to be construed to cover all equivalent structures falling within the scope and the spirit of the invention.

I claim:

1. A double-action brief case comprising a central valence member, two oppositely disposed five-sided side shells hinged together via said central valence member, the sixth and open side of each of the two side shells coming together on opposite sides of the valence, double-action locking means on the valence for alternatively securing said two side shells individually in closed positions adjacent the valence, and for releasing said side shells as desired, said locking control means operable to release either of said side shells independently of the other and to release both said shells simultaneously with one manual operation;

first side shell latching means extending from said first side shell into said locking means and cooperating with said double action locking means to release one side shell from the valence when said locking means is operated, second side shell latching means extending from said second side shell into said locking means and cooperating with said double action locking means to release another side shell from the valence when said locking means is operated, and a deep tray closed compartment secured in the valence, the deep tray facing one side shell to form in cooperation therewith a closed compartment while completely blocking the other side shell from view, said first and second side shell latching means comprising hasps, said hasps having a grooved shape enabling restraint and release by said double action locking means whereby said side shells are merged with said valence when said hasps are restrained and released from said valence when said hasps are released from said double action locking means, and said locking means including four locks, two at each end of said valence, each of said side shells having said hasps on opposite ends, to cooperate with individually associated ones of said locks, said two locks at each end of said valence having directionally opposing lock release means requiring reverse directional movement of each of said locks at each end of said valence respectively to simultaneously release both side shells.

2. A double-action brief case comprising a central valence member, two oppositely disposed five-sided side shells hinged together via said central valence member, the sixth and open side of each of the two side shells coming together on opposite sides of the valence, double-action locking means on the valence for alternatively securing two side shells individually in closed positions adjacent the valence, and for releasing said side shells as desired, said locking control means operable to release either of said side shells independently of the other and to release both said shells simultaneously with one manual operation;

first side shell latching means extending from said first side shell into said locking means and cooperating with said double action locking means to release one side shell from the valence when said locking means is operated, second side shell latching means extending from said second side shell into said locking means and cooperating with said double action locking means to release another side shell from the valence when said locking means is operated, and a deep tray closed compartment secured in the valence, the deep tray facing one side shell to form in cooperation therewith a closed compartment while completely blocking the other side shell from view, said locking means including toggle clasp means which cooperate with said first and second side shell latching means towards alternatively releasing said side shells independently of each other as well as simultaneously to each other as a function of the position to which said toggle clasp means is pivoted.

3. The brief case of claim 2 wherein said locking means further comprises locking means at each opposite end of said valence.

4. The brief case of claim 2 wherein both of said shells may be released simultaneously by an intentional action of twice operating said toggle clasp means in each of two opposite directions.

5. A double-action brief case comprising a central valence member, two oppositely disposed five-sided side shells hinged together via said central valence member, the sixth and open side of each of the two side shells coming together on opposite sides of the valence, double-action locking means on the valence for alternatively securing said two side shells individually in closed positions adjacent the valence, and for releasing said side shells as desired, said locking control means operable to release either of said side shells independently of the other and to release both said shells simultaneously with one manual operation;

first side shell latching means extending from said first side shell into said locking means and cooperating with said double action locking means to release one side shell from the valence when said locking means is operated, second side shell latching means extending from said second side shell into said locking means and cooperating with said double action locking means to release another side shell from the valence when said locking means is operated, and a deep tray closed compartment secured in the valence, the deep tray facing one side shell to form in cooperation therewith a closed compartment while completely blocking the other side shell from view, said locking means including two locks, one at each end of said valence, and toggle clasp means at the center of said valence, each of said two locks cooperating with said first and second side shell latching means located on opposite ends of each of said side shells respectively, and said toggle clasp means cooperating with said first and second side shell latching means located at the center of each of said side shells so as to enable alternatively individual securement of each of said side shells to said valence, and individual or simultaneous release of said side shells from said valence.

* * * * *